US005365915A

United States Patent [19]

Yu

[11] Patent Number: 5,365,915

[45] Date of Patent: Nov. 22, 1994

[54] TILE CUTTING TOOL

[76] Inventor: Chin-Yung Yu, No. 5, Cheng Te Lane 3, Shu Te Li, South Area, Taichung, Taiwan

[21] Appl. No.: 71,964

[22] Filed: Jun. 7, 1993

[51] Int. Cl.[5] ..... B28D 1/32

[52] U.S. Cl. ..... 125/23.02; 125/38; 7/158; 30/145

[58] Field of Search ..... 125/23.01, 23.02, 36, 125/38; 7/158; 30/145, 359, 363

[56] References Cited

U.S. PATENT DOCUMENTS

| | | | |
|---|---|---|---|
| 785,230 | 3/1905 | Roberts | 30/145 |
| 2,589,501 | 3/1952 | Lenarduzzi | 125/23.02 |
| 4,444,174 | 4/1984 | Hepworth et al. | 125/23.02 |
| 4,829,976 | 5/1989 | Pourta et al. | 125/36 |
| 5,207,014 | 5/1993 | Panella | 7/136 |

FOREIGN PATENT DOCUMENTS

| | | | |
|---|---|---|---|
| 2604733 | 1/1977 | Germany | 125/23.02 |

*Primary Examiner*—M. Rachuba

*Attorney, Agent, or Firm*—Bacon & Thomas

[57] ABSTRACT

A tile cutting tool including two opposing cutters integrally and respectively extended from two pivoted blades and disposed in reversed directions, two jaw plates respectively fastened to the cutters at one side, a cutting wheel fastened between the cutters and the jaw plates for making a scratch on the workpiece, the jaw plates including one having a concave middle part and the other having a convex middle part fitting over the concave middle part, whereby the jaw plates are worked against each other to break the workpiece along the scratch being made on the workpiece by the cutting wheel.

1 Claim, 5 Drawing Sheets

TILE CUTTING TOOL

BACKGROUND OF THE INVENTION

The present invention relates to tile cutting tools for cutting tiles.

Various tiles are manufactured, and widely used for covering the floors or walls of a building. Because floor and wall tiles are durable in use and east to wash, they are more and more popularly accepted. However, because floor or wall tiles are made in fixed sizes, they may have to be properly cut to fit different corner areas. For cutting tiles, special cutting tools must be used. FIGS. 1 and 2 illustrate two different tile cutting tools for cutting tiles. The tool shown in FIG. 1 is specifically designed for cutting the edge of a tile. The tool shown in FIG. 2 is specifically designed for making a scratch on a tile and then breaking the tile along the scratch being made. Because these two tile cutting tools are respectively designed for different purposes, they must be simultaneously prepared. However, preparing two different tile cutting tools greatly increases the tool cost as well as the storage space. It is also inconvenient to carry and use different tile cutting tools. Further, because the tile cutting tool shown in FIG. 2 is operated to give pressure to the tile to be cut through three points of load on the same plane, the tile may break into pieces easily when it is squeezed by the tile cutting tool.

SUMMARY OF THE INVENTION

The present invention has been accomplished under the aforesaid circumstances. It is therefore the principal object of the present invention to provide a tile cutting tool which is comprised of a cutter unit and a chuck unit for cutting and trimming all tiles as desired. It is another object of the present invention to provide a tile cutting tool which does not damage the tile during the cutting operation. Because the tile cutting tool is practical for cutting tiles as well as for trimming tiles, no any additional tool is needed, and therefore the tool cost is reduced.

DETAILED DESCRIPTION OF THE PREFERRED

Figure 1:
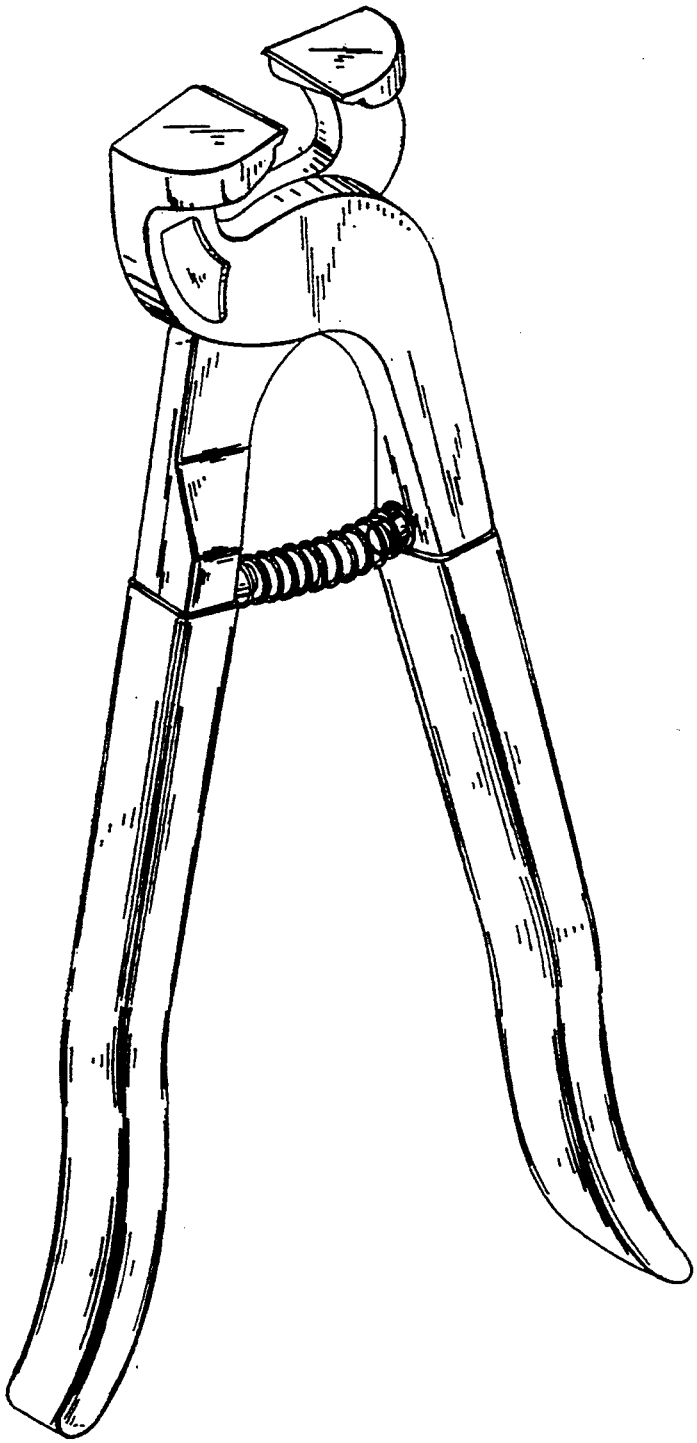
Fig. 1 PRIOR ART
FIG. 1 is a perspective view of a tile cutting tool according to the prior art.
Figure 2:
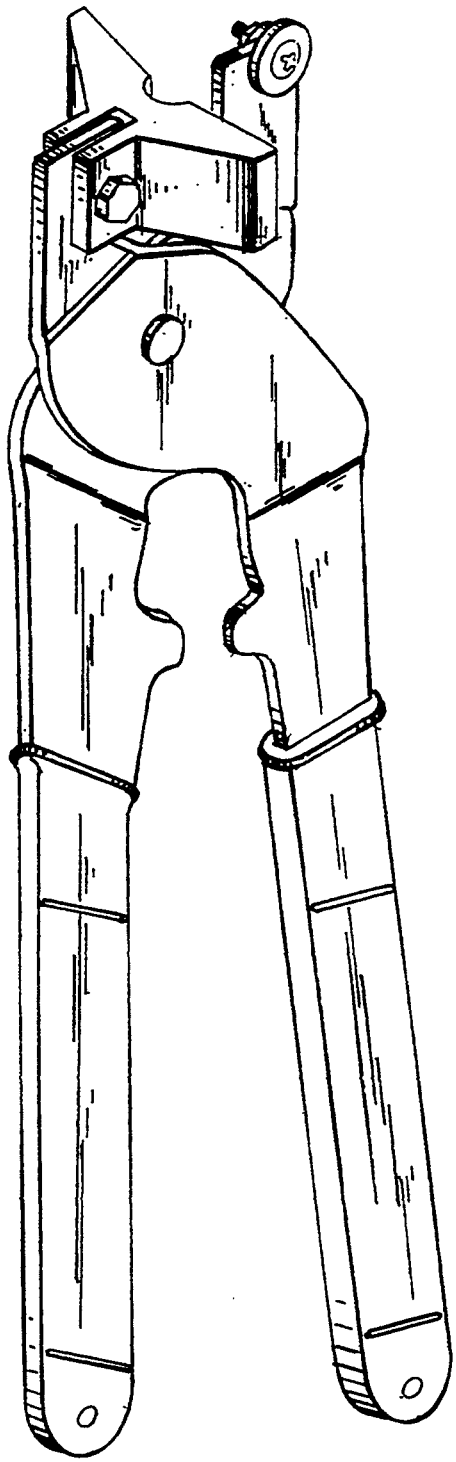
Fig. 2 PRIOR ART
FIG. 2 is a perspective view of a tile chucking cutter device according to the prior art.
Figure 3:
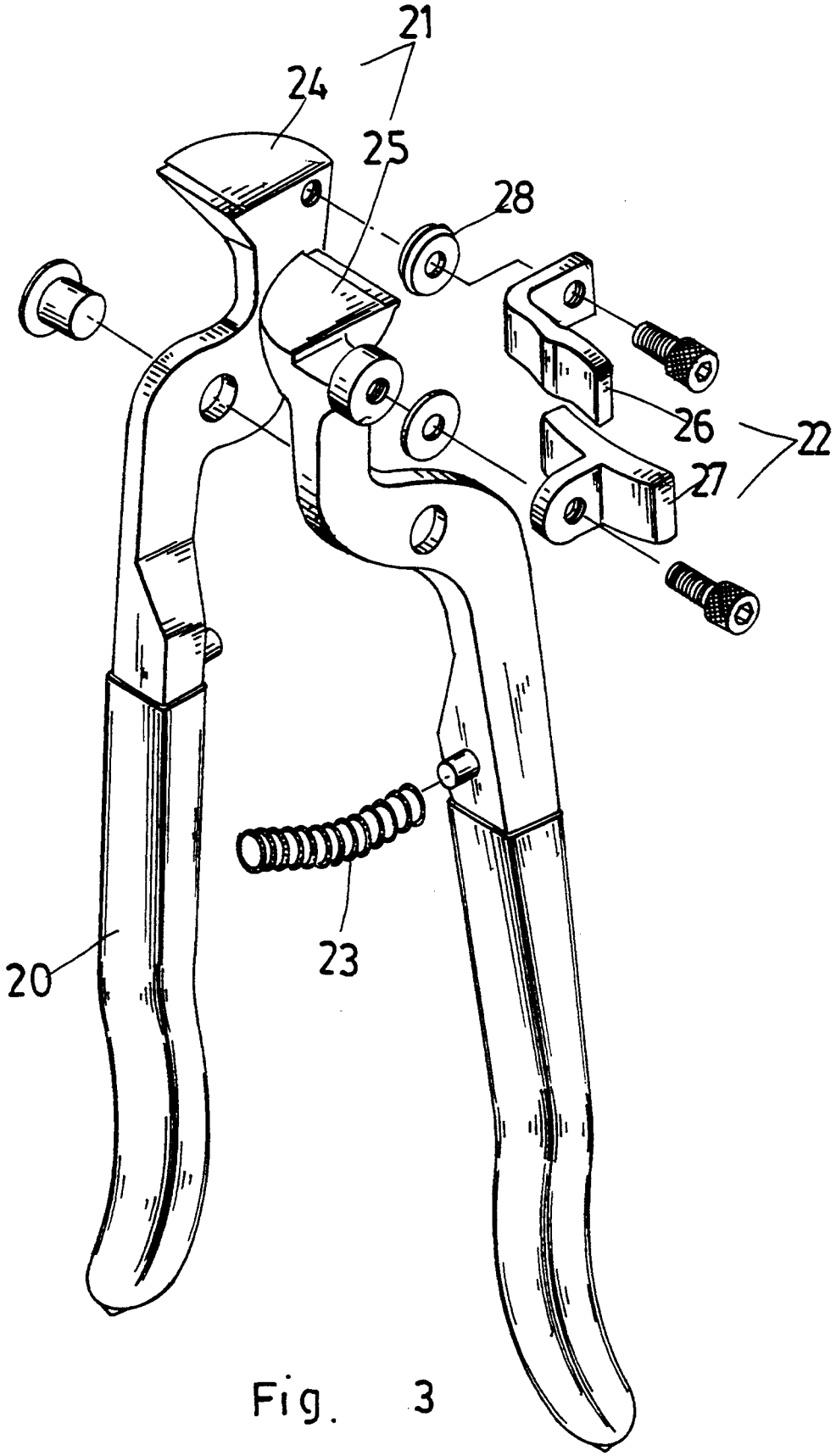
FIG. 3 is a perspective exploded view of a tile cutting tool according to the present invention.

Referring to FIG. 3, a tile cutting tool in accordance with the present invention is generally comprised of two opposing pivoted blades 20 moved to work against each other, a compression spring 23 retained between the pivoted blades 20 for auto return control, a cutter unit 21 and a chuck unit 22 respectively made or fastened to the body 20 at one end. The cutter unit 21 is compressed of two cutters 24;25 integrally and respectively extended from the pivoted blades 20 and disposed in reversed directions. The chuck unit 22 is comprised of two opposing jaw plates, namely, the first jaw plate 26 and the second jaw plate 27 respectively fastened to the cutters 24;25 at the same side. The second jaw plate 27 has a middle part curved inwards. The first jaw plate 26 has a middle part curved outwards fitting over the concave middle part. A cutting wheel 28 is fastened between the cutter unit 21 and the chuck unit 22 for making a scratch on the tile to be cut.

Figure 4:
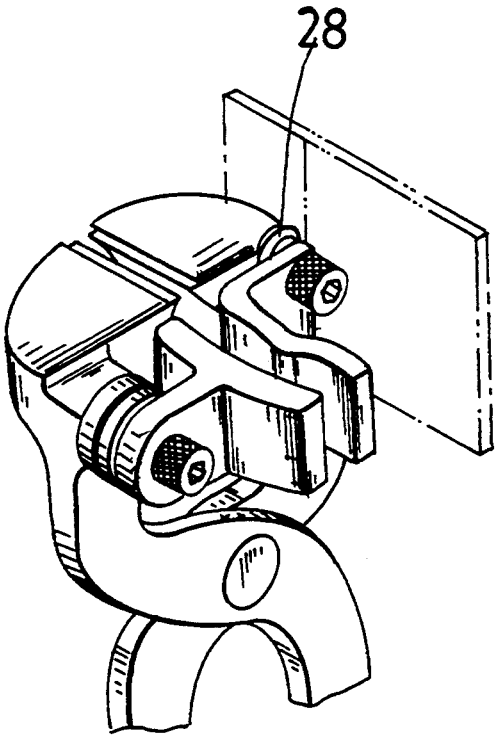
FIG. 4 illustrates a tile cutting tool of the present invention operated to make a scratch on the workpiece by the cutting wheel thereof.
Figure 5:
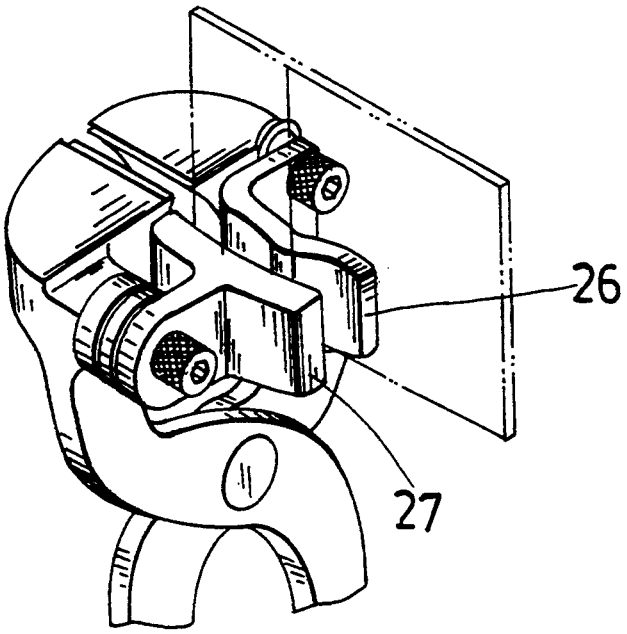
FIG. 5 illustrates the jaw plates of the chuck unit of a tile cutting tool of the present invention worked against each other to break the workpiece retained therebetween.

Referring to FIGS. 4 and 5, the tile cutters can be used for cutting a tile into two parts by making a scratch on the tile to be cut along the area to be separated, then putting the tile in between the first and second jaw plates 26;27, and then squeezing the first and second jaw plates 26;27 against each other. As the convex middle part of the first jaw plate 26 is squeezed toward the concave middle part the second jaw plate 27, the tile is immediately broken into two parts along the scratch made.

Figure 6:
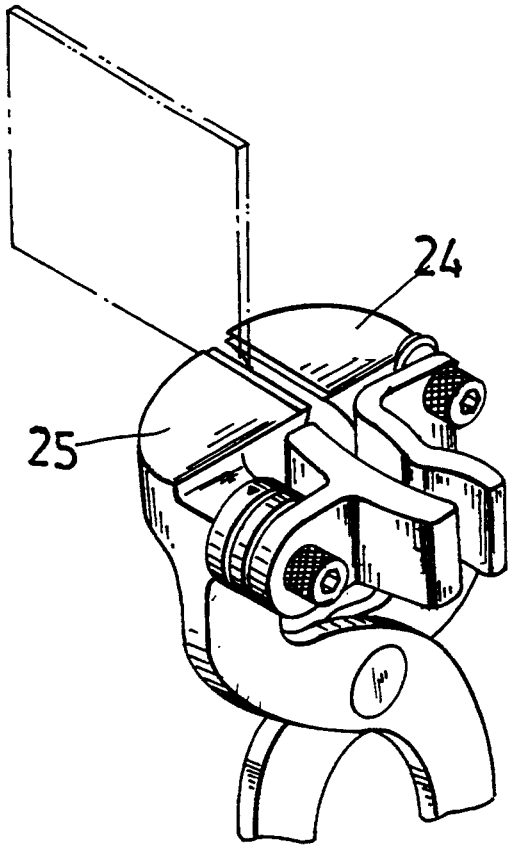
FIG. 6 illustrates the cutting tool of the cutter unit worked against each other to cut off the edge of the workpiece.

Referring to FIG. 6, the first and second cutters 24;25 of the cutter unit 21 are operated to cut off the edge of the workpiece.

Because the present invention is practical for cutting tiles as well as trimming tiles, one single piece of the tile cutting tool is sufficient for all purposes. Because the chuck unit comprises two opposing jaw plates for chucking the workpiece, pressure is evenly distributed through the workpiece, and therefore the workpiece does not break into pieces when it is squashed.

I claim:

1. A tile cutting tool comprising two opposing pivoted blades moved to work against each other, a cutter unit comprised of two cutters integrally and respectively extended from said pivoted blades and disposed in reversed directions, a chuck unit comprised of a first jaw plate and a second jaw plate respectively fastened to said cutters at one side, a cutting wheel fastened between said cutter unit and said chuck unit for making a scratch on the tile to be cut, said jaw plates including one having a concave middle part and the other having a convex middle part fitting over said concave middle part, whereby said cutters are worked against each other to cut the edge of the workpiece; said jaw plates of said chuck unit are worked against each other to break the workpiece along the scratch being made on the workpiece by said cutting wheel.

* * * * *